US007828556B2

(12) United States Patent
Rodrigues

(10) Patent No.: US 7,828,556 B2
(45) Date of Patent: Nov. 9, 2010

(54) AUDIO MAGNETIC CONNECTION AND INDEXING DEVICE

(75) Inventor: Anthony G. Rodrigues, Manteca, CA (US)

(73) Assignee: Stanton Magnetics, Inc., Deerfield Beach, FL (US)

( * ) Notice: Subject to any disclaimer, the term of this patent is extended or adjusted under 35 U.S.C. 154(b) by 0 days.

(21) Appl. No.: 12/079,970

(22) Filed: Mar. 31, 2008

(65) Prior Publication Data

US 2009/0246979 A1 Oct. 1, 2009

(51) Int. Cl.
*H01R 11/30* (2006.01)

(52) U.S. Cl. ..... 439/38; 381/394; 439/928

(58) Field of Classification Search ..... 439/38, 439/39, 40; 381/394, 395
See application file for complete search history.

(56) References Cited

U.S. PATENT DOCUMENTS 4,546,267 A * 10/1985 Urfirer ..... 307/116
5,401,175 A * 3/1995 Guimond et al. ..... 439/38
5,615,618 A * 4/1997 Berdut ..... 104/290
6,561,815 B1 5/2003 Schmidt
7,311,526 B2 12/2007 Rohrbach et al.
7,322,863 B2 * 1/2008 Rapp ..... 439/620.01
7,322,873 B2 * 1/2008 Rosen et al. ..... 446/91
7,378,271 B2 * 5/2008 Bader ..... 435/289.1
2003/0095671 A1 * 5/2003 Long ..... 381/87
2004/0209489 A1 10/2004 Clapper
2005/0047621 A1 * 3/2005 Cranfill et al. ..... 381/334
2006/0133625 A1 * 6/2006 Adams et al. ..... 381/120
2006/0147080 A1 * 7/2006 Wilson et al. ..... 381/386
2008/0123894 A1 * 5/2008 Lu ..... 381/394

* cited by examiner

*Primary Examiner*—Neil Abrams
*Assistant Examiner*—Phuong Nguyen
(74) *Attorney, Agent, or Firm*—Stone Creek LLC; Alan M. Flum

(57) ABSTRACT

The disclosure relates to the use of magnets, which may be permanent magnets or electromagnets, to align and physically connect two adjacent audio components, or similar electronic components. Alternatively, a groove or similar mechanical aligning configuration may be used in combination with the magnetic configuration.

8 Claims, 3 Drawing Sheets

AUDIO MAGNETIC CONNECTION AND INDEXING DEVICE

BACKGROUND OF THE INVENTION

1. Field of the Invention

The present invention pertains to an apparatus and method for connecting two pieces of related audio gear, or similar electronic devices, using magnetism. This allows indexing of the relative position of the devices while allowing easy repositioning of the devices in relation to one another.

2. Description of the Prior Art

In the field of audio or similar electronic components, typically the components are attached together mechanically using external fasteners, such as screws or hooks. Alternatively, complex tooling may be used as a fastening system which does not require external fasteners. However, using tooling a mechanical fasteners may result in difficulties in indexing the products to one another in order to achieve the best ergonomics or appearance. Moreover, such mechanical implementations may wear after repeated insertions and extractions and may result in inaccurate positioning and indexing.

Apple computers use a magnetic device to attach a power cable to certain laptop computers. Similarly, magnets are used to secure electrical connections in U.S. Pat. No. 6,561,815 to Schmidt and Published Application No. 2004/0209489 A1 to Clapper.

Finally, some toy trains use magnetic couplers to attach the train cars together.

OBJECTS AND SUMMARY OF THE INVENTION

It is therefore an object of the present invention to provide a method and apparatus for attaching audio or similar electronic components, while eliminating or reducing the use of external fasteners.

This and other objects are attained by using magnetic connections between audio or similar electronic components. This allows control surfaces, audio interfaces and other device to attach to one another easily while eliminating or reducing the use of external fasteners. Magnets of opposed polarity are used in each component or device whereby the attraction of the magnets is sufficient to override any other magnetic attraction between the components or devices, such as from a magnet to a steel interior structure. Another embodiment provides at least one magnet in one component or device which is attracted to a ferrous plate in another component or device, relying upon a mechanical indexing structure (such as, but not limited to, a nipple to dimple structure) whereby the magnets apply the attracting force while the mechanical indexing structure aligns the components or devices. In this embodiment, the indexing may be overridden by simply not aligning the mechanical indexing structure, thereby providing the benefits of magnetic attraction and the creation of a connected structure.

BRIEF DESCRIPTION OF THE DRAWINGS

Further objects and advantages of the invention will become apparent from the following description and from the accompanying drawings and claims, wherein:

DETAILED DESCRIPTION OF THE PREFERRED EMBODIMENTS

Figure 1:
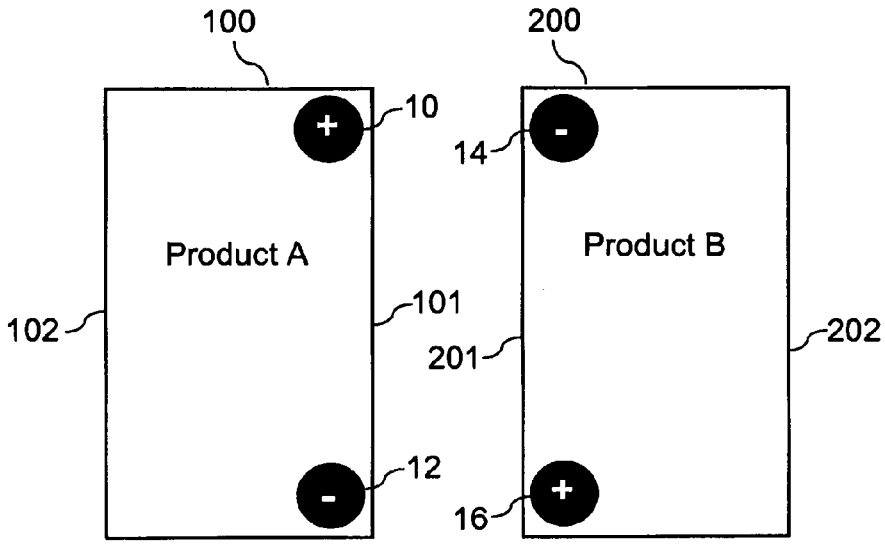
FIG. 1 is a schematic of a first embodiment of the present invention with two pairs of opposed magnets for the connection of two devices or components.

Referring now to the drawings in detail wherein like numerals indicate like elements throughout the several views, one sees that FIG. 1 is a schematic of the first embodiment of the present invention. More specifically, FIG. 1 shows the respective abutting ends 101, 201 of the exterior cases of electronic components 100 and 200 which are to be positioned against each other. Electronic components 100, 200 may be audio components, such as, but not limited to, power amplifiers, pre-amplifiers, integrated amplifiers, radio tuners, CD or DVD players or other audio sources or sound processors. Furthermore, electronic components 100, 200 may be audio/visual recording devices or scientific instruments, but are not limited thereto.

Component 100 includes magnet 10 outwardly presenting a positive pole on an upper portion of end 101 of component 100 and further includes magnet 12 outwardly presenting a negative pole on a lower portion of end 101 of component 100. Likewise, component 200 includes magnet 14 outwardly presenting a negative pole on an upper portion of end 201 of component 200 and further includes magnet 16 outwardly presenting a positive pole on a lower portion of end 201 of component 200. Therefore, the respective ends 101, 201 of components 100, 200 can abut so that magnet 10 is aligned with and adjacent to magnet 14 thereby resulting in magnetic attraction between the two. Likewise, magnet 12 is aligned with and adjacent to magnet 16 thereby resulting in magnetic attraction between the two. The resulting magnetic attraction further results in the desired alignment of components 100, 200 with each other. It should be noted that the magnets 12, 14, 16, 18 are shown for ease of simplicity of illustration on the illustrated planar faces, but actually present the poles on the ends 101, 201.

Figure 2:
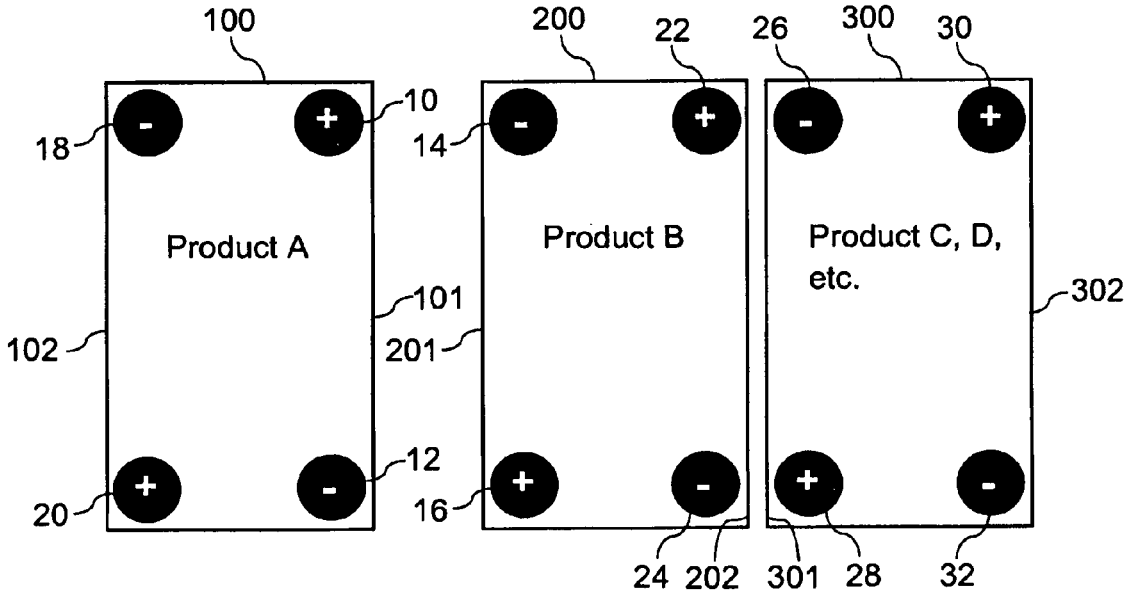
FIG. 2 is a schematic of the second embodiment of the present invention with opposed magnets on both ends of the two devices or components, illustrating how successive components or devices may be interchangeably connected.

Moreover, magnets 12, 14, 16, 18 can be implemented as neodymium or similar permanent magnets. Magnets 12, 14, 16, 18 can likewise be implemented as electromagnets FIG. 2 illustrates how components 100, 200 can mount magnets on both ends of the components 100, 200. Component 100 includes magnets 10, 12 as illustrated in FIG. 1. Further, component 100 includes magnet 18 outwardly presenting a negative pole on an upper edge of end 102 of component 100 and further includes magnet 20 outwardly presenting a positive pole on a lower edge of end 102 of component 100 thereby allowing similar components to be aligned to the left of component 100. Likewise, component 200 includes magnets 14, 16 as illustrated in FIG. 1. Further, component 200 includes magnet 22 outwardly presenting a positive pole on an upper edge of end 202 of component 200 and further includes magnet 24 outwardly presenting a negative pole on a lower edge of end 202 of component 200. Component 300 is configured similarly or substantially identically with component 200 so that magnets 26, 28, 30, 32 correspond to magnets 14, 16, 22, 24, respectively. Therefore, the respective ends 202, 301 of components 200, 300 can abut so that magnet 22 is aligned with and adjacent to magnet 26 thereby resulting in magnetic attraction between the two. Likewise, magnets 30, 32 on side 302 of component 300 can be aligned with and adjacent to magnets on an end of a further successive component (not shown).

Figure 3:
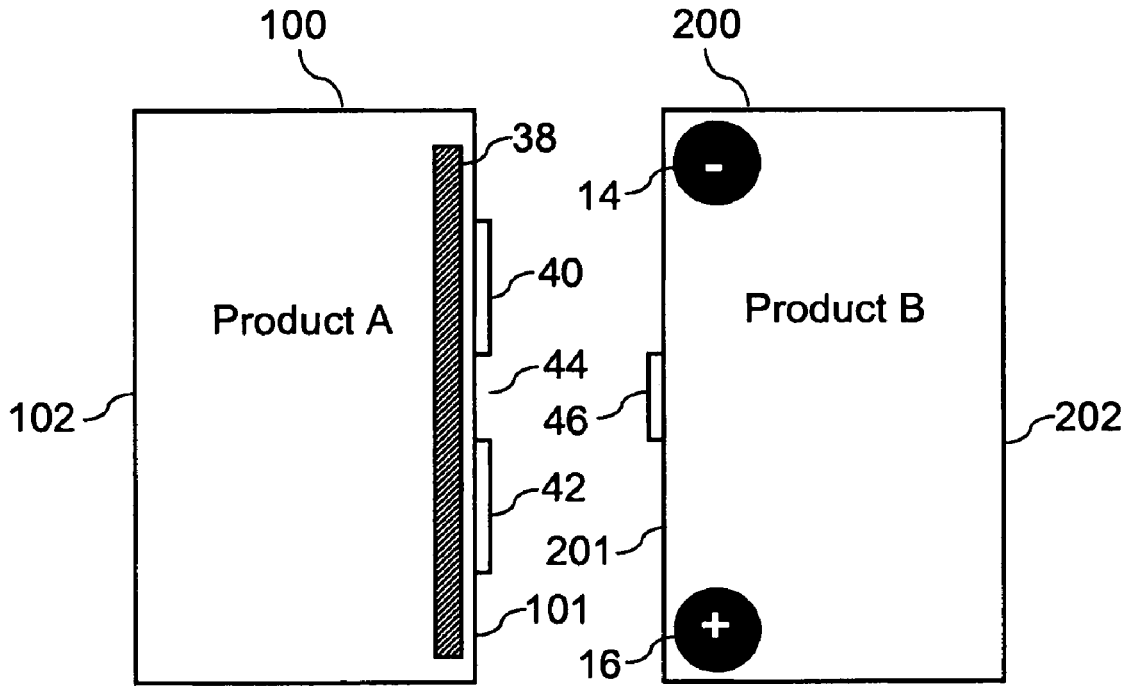
FIG. 3 is a schematic of a third embodiment of the present invention, with mechanical indexing structures on both components and at least one magnet on one component, being attracted to a metal (ferrous) plate of another component.
Figure 4:
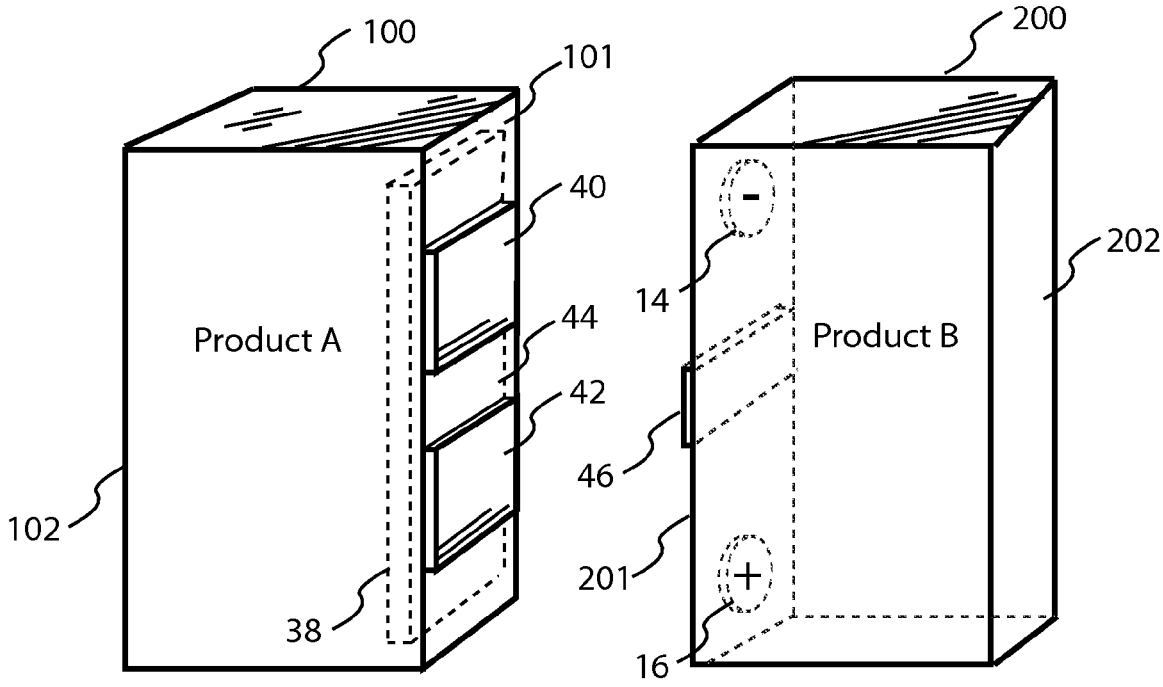
FIG. 4 is a front perspective view of embodiment of the present invention of FIG. 3.

In the embodiment shown in FIG. 3, component 100 includes a ferrous or metal plate 38 imbedded inwardly adjacent from end 101. End 101 further includes spacer plates 40, 42 spaced apart thereby forming a gap or aligning groove 44 therebetween. Component 200 is configured as shown in FIG. 1, and further includes a protruding boss plate 46 configured and arranged to fit or mate into aligning groove 44. Therefore, when components 100, 200 are aligned with each other, magnets 14, 16 are magnetically attracted to ferrous or metal plate 38 while boss plate 46 assures mechanical alignment by fitting into groove 44.

This provides for alignment of the various components. Moreover, the use of electromagnets in this embodiment is particularly attractive as the connection between two successive components 100, 200 depends upon the magnetism in a single component 100, and the magnetism can be turned off by use of a single switch (not shown).

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. An audio electronic device:

said audio electronic device is selected from a group consisting of standalone audio control surface devices, CD players, DVD players, sound processors, and audio/visual recording devices;

a first audio electronic device including a first substantially rectangular exterior case, with a first substantially rectangular upward facing top surface and a first substantially rectangular continuously closed planar end approximately perpendicular to said first top surface;

a second audio electronic device, similar to said first audio electronic device, including a second substantially rectangular exterior case with a second substantially upward facing planar rectangular top surface and a second continuously closed planar end approximately perpendicular to said second top surface, wherein said first closed planar end is configured and arranged to abut said second closed planar end;

said first closed planar end including a component within said first exterior case and proximate to said first closed planar end interior surface which is magnetically attracted, and a single horizontal aligning groove running approximately the full length of said first closed planar end exterior surface; and said second closed planar end including at least one magnet within said second exterior case and proximate to said second closed planar end interior surface and further including a horizontal mating element, running approximately the full length of said second closed planar end exterior surface, arranged and configured to mate with said horizontal aligning groove when said first end abuts said second end.

2. The audio electronic device claim 1 wherein said component is a ferrous plate formed inwardly of said first closed planar end.

3. The audio electronic device of claim 1 wherein said component is at least one magnet.

4. The audio electronic device of claim 1 wherein said groove is formed as a gap between two plates on said first closed planar end.

5. The audio electronic device of claim 1 wherein said second mating element is a protrusion for aligning within said groove.

6. The audio electronic device of claim 1 wherein said at least one magnet is at least one electromagnet.

7. The audio electronic device of claim 1 wherein said at least one magnet comprises a first magnet and a second magnet.

8. The audio electronic device of claim 7 wherein said first magnet presents a negative pole to said exterior case and said second magnet presents a positive pole to the said exterior case.

* * * * *